US008402981B2

(12) United States Patent
Liu

(10) Patent No.: US 8,402,981 B2
(45) Date of Patent: Mar. 26, 2013

(54) PROTECTIVE ELEMENT

(75) Inventor: Kai Liu, Zhejiang Province (CN)

(73) Assignee: Yotrio Group Co., Ltd., Linhai, Zhejiang (CN)

( * ) Notice: Subject to any disclaimer, the term of this patent is extended or adjusted under 35 U.S.C. 154(b) by 125 days.

(21) Appl. No.: 12/522,508

(22) PCT Filed: Feb. 11, 2008

(86) PCT No.: PCT/DE2008/000231

§ 371 (c)(1),
(2), (4) Date: Jul. 8, 2009

(87) PCT Pub. No.: WO2008/098557

PCT Pub. Date: Aug. 21, 2008

(65) Prior Publication Data

US 2010/0037929 A1 Feb. 18, 2010

(30) Foreign Application Priority Data

Feb. 15, 2007 (DE) ..... 10 2007 008 069
May 4, 2007 (DE) ..... 10 2007 021 400

(51) Int. Cl.
*A45B 11/00* (2006.01)
*A45B 23/00* (2006.01)
*A45B 25/00* (2006.01)

(52) U.S. Cl. ..... 135/20.3; 135/15.1; 135/21

(58) Field of Classification Search ..... 135/15.1, 135/20.3, 21
See application file for complete search history.

(56) References Cited

U.S. PATENT DOCUMENTS

| | | | | |
|---|---|---|---|---|
| 5,499,644 | A | 3/1996 | Geniele | |
| 6,575,183 | B2 * | 6/2003 | Tung | 135/20.3 |
| 6,637,717 | B2 * | 10/2003 | Li | 248/519 |
| 6,923,193 | B2 * | 8/2005 | Chen | 135/20.1 |
| 6,988,504 | B1 * | 1/2006 | Goldwitz | 135/20.1 |
| 7,134,442 | B2 * | 11/2006 | Ma | 135/20.1 |
| 7,708,902 | B2 * | 5/2010 | Ohkoshi et al. | 252/62.58 |
| 7,836,902 | B2 * | 11/2010 | Tung | 135/20.3 |
| 2001/0040208 | A1 | 11/2001 | Li | |
| 2004/0261827 | A1 | 12/2004 | Chen | |
| 2006/0278262 | A1 | 12/2006 | Ma | |

OTHER PUBLICATIONS

International Search Report for PCT/DE2008/000231.
English translation of International Preliminary Report on Patentability/Written Opinion of the International Searching Authority for PCT/DE2008/000231.

* cited by examiner

*Primary Examiner* — David Dunn
*Assistant Examiner* — Danielle Jackson
(74) *Attorney, Agent, or Firm* — Jingming Cai; Schein & Cai LLP

(57) ABSTRACT

The invention relates to a protective element, especially a suspended protective element for using as a parasol or an umbrella, comprising a vertical pole, a protective cover element, and a holding structure connected to the vertical pole. The holding structure is rotatably mounted in relation to the vertical pole, and the rotational axis of the support extends at least approximately parallel to the longitudinal axis of the vertical pole.

6 Claims, 8 Drawing Sheets

PROTECTIVE ELEMENT

Figure 1:
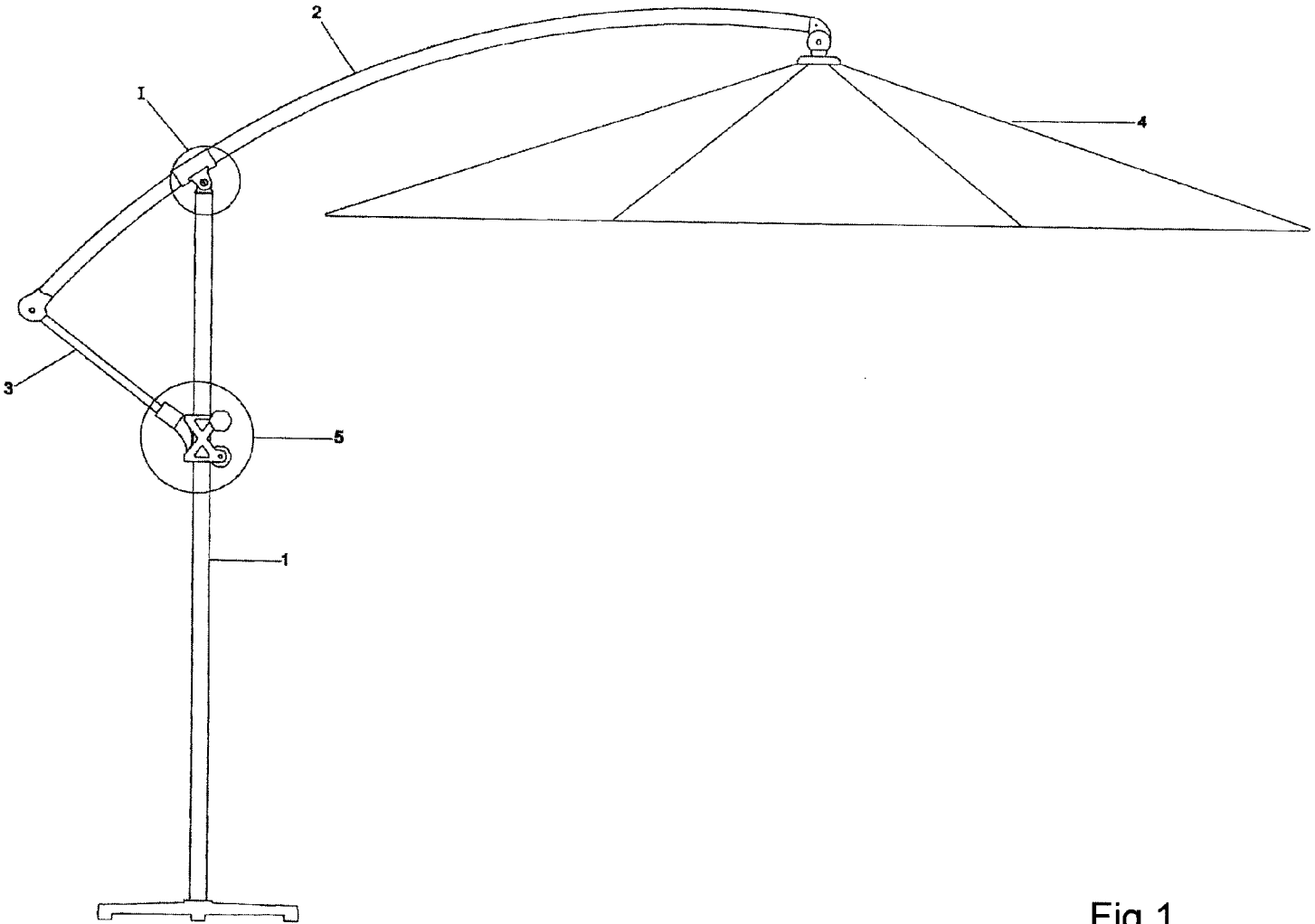

The present invention relates to an umbrella, in particular a suspended or offset umbrella, for use as protection from sun or rain, said umbrella comprising a vertical pole, an umbrella canopy, and a holding structure, which is connected to the vertical pole and is intended for the umbrella canopy.

For years, umbrellas of the type in question are known to be used in recreational facilities and garden areas. Umbrellas enjoy great popularity especially in the food and beverage industry, which can be attributed in no small part to the large umbrella designs now possible. Thus, umbrellas with canopies having a diameter of several meters are available on the market these days. Due to their size, these umbrellas have a large weight and a large area that is exposed to the wind, which makes it necessary to appropriately anchor the umbrella to the ground. For ensuring a secure positioning of the umbrella, a holding structure, which stretches and supports the umbrella canopy, is therefore connected to a vertical pole, which is either permanently founded in the ground or formed integrally with a heavy, tilt-resistant pedestal.

In recent years, there has been a widespread use of so-called suspended or offset umbrellas. In these umbrellas, the suspended umbrella canopy is spaced apart in the radial direction from the vertical pole used for anchoring the holding structure. Therefore, the major advantage of suspended or offset umbrellas is that the vertical pole is located outside or at the edge of the canopied area. This enables the convenient use of the canopied area without being obstructed by the vertical pole, which is advantageous, for example, when positioning garden or restaurant furniture or when sheltering people inside the canopied area.

Quite obviously, such suspended or offset umbrellas necessitate a much more secure anchoring to the ground than centrally supported umbrellas since the umbrella is at a risk of toppling over due to its own weight, the center of gravity of which is located far from the longitudinal axis of the vertical pole. The disadvantage involved all the more in the very solid anchoring required by the vertical pole unlike centrally supported umbrellas is that it is considerably difficult, due to the increased weight of the pedestal, and thus extremely cumbersome or even impossible, due to the permanently fixed position of the pedestal, to rearrange the umbrella, e.g. to adjust it to the changing position of the sun during the course of the day.

The object underlying the present invention therefore is to design and develop an umbrella of the afore-mentioned kind, in particular a suspended or offset umbrella, in such a way that it can be comfortably aligned in the horizontal plane, as required, for example, for adjusting it to the changing environmental conditions such as the position of the sun, wind direction and the like.

According to the invention, the object mentioned above is achieved with the characteristics of claim 1. Accordingly, an umbrella, in particular a suspended or offset umbrella of the afore-mentioned type is characterized in that the holding structure is mounted such that it can rotate in relation to the vertical pole, and the rotational axis of the bearing extends at least approximately parallel to the longitudinal axis of the vertical pole.

It has been found according to the invention that a horizontal alignment of the umbrella can be achieved in a technically simple and simultaneously user-friendly way by mounting the holding structure supporting the umbrella canopy such that the holding structure can rotate in relation to the vertical pole. The advantage of this design is that firstly a particularly firm anchoring can be achieved for the vertical pole, for example, by forming a particularly heavy pedestal of the vertical pole or even by founding the vertical pole in the ground, thereby enabling the absorption of high forces or torques. At the same time, the ability of the holding structure to rotate enables a comfortable alignment of the umbrella in the horizontal plane despite the solid anchoring of the vertical pole since the holding structure together with the umbrella canopy suspended thereon can be rotated in relation to the vertical pole around a rotational axis, which extends at least approximately parallel to the longitudinal axis of the vertical pole. The holding structure with the umbrella canopy attached thereto can rotate by 360° around the stationary vertical pole.

An additional advantageous effect of the umbrella of the invention is the easy operability of the rotating bearing. This is because the bearing of the holding structure can be disposed at an easily accessible height in relation to the vertical pole by providing the vertical pole with an appropriately selected length so that the user need not stoop down or stretch to activate the rotating bearing. In principle, the high-level arrangement of the bearing, that is to say, in the case of a long vertical pole, reduces the weight of the holding structure to be received by the rotating bearing since the holding structure can be formed with appropriately smaller dimensions in terms of height if the vertical pole is already high. This enables a simple design for the bearing, which in turn results in a reduction of costs.

It must be pointed out at this point that the idea described above and underlying the invention can basically be applied to all umbrella designs and is thus not restricted to the field of offset or suspended umbrellas.

The rotational axis advantageously coincides with the longitudinal axis of the vertical pole. This firstly results in a small requirement of space and secondly, especially in the afore-mentioned offset umbrellas, the ability of the umbrella canopy to move on a circular path around the vertical pole as the rotational axis since the umbrella canopy is spaced apart from the vertical pole in the radial direction. Depending on the radial extension of the holding structure, the umbrella canopy can thus be easily repositioned by several meters and at most by twice the radial extension of the holding structure in the case of a 180° rotation of the holding structure. Additional provisions can be made to enable the adjustment of the radial spacing of the umbrella canopy from the vertical pole.

In principle, it is feasible to mount the holding structure such that it can rotate in relation to the vertical pole by means of a rolling bearing and/or a sliding bearing. The advantage of the bearing formed as a rolling bearing is its ability to rotate easily even when absorbing large bearing loads or torques. The bearing wear is extremely small, thereby enabling a particularly long service life to be achieved. Alternatively or additionally, a sliding bearing can be used for mounting the holding structure. Due to their small number of required components, which in the simplest case include a bearing shell or sleeve and a bearing pin rotatable therein, sliding bearings can be produced economically, have low weight and can further be mounted or demounted easily. Particularly as a result of the simple mounting and demounting of the slide bearing, an appropriately designed sliding bearing can be used to likewise enable an easy demounting of the umbrella, which in turn is an additional advantage. Combinations of sliding and rolling bearings are naturally also feasible for mounting the holding structure.

A material and space-saving, and simultaneously elegant mounting of the holding structure in relation to the vertical pole can be achieved advantageously from a technical viewpoint by providing the upper end of the vertical pole with a hollow design and an opening in order to rotatably receive one portion of a connecting element, which is integrally formed with the holding structure or connected to the holding structure. The hollow design of the upper end of the vertical pole, that is to say, that end of the vertical pole that is oriented toward the holding structure, results in an easily mountable bearing, wherein the connecting element is received at least partly by the opening of the vertical pole. A corresponding design of the vertical pole and the connecting element results in a bearing for the holding structure in relation to the vertical pole, which bearing is cohesive due to gravitational force. In the simplest case, the bearing used is a sliding bearing. It should be pointed out that the bearing described above can naturally also be constructed the other way around but with the same effect, wherein the connecting element is then provided with an at least partly hollow design and an opening for receiving one portion of the upper end of the vertical pole. The possible designs described below as being further advantageous must then be adapted accordingly.

A hollow design of the vertical pole is already ensured if the vertical pole and incidentally also additional components of the holding structure are designed as shafts or pipes. Pipes have a favorable ratio of stability to weight. The shafts or pipes can be made of aluminum or steel by way of example. Aluminum though lighter tends to malfunction as compared to steel. Fabricating the vertical pole from wood can impart a classy appearance to the vertical pole due to the special visual characteristics and surface feel of wood. In principle, the vertical pole and components of the holding structure can be fabricated with a round, angular, oval or similarly profiled cross-sections in order to have appropriate buckling stability.

For implementing the bearing in the form of a sliding bearing and/or rolling bearing, it is advantageous if that portion of the connecting element that is received by the vertical pole is formed as a pin, which has a substantially cylindrical basic shape at least in the bearing area, that is to say, in the area of the sliding contact and/or in the area of the bearing surface. Due to such a shape, the peripheral surface of the pin, that is to say, its lateral surface, makes contact directly or indirectly (by means of a rolling bearing) with a preferably socket-type inner surface of the vertical pole, as a result of which the connecting element is mounted rotatably. In doing so, it could be worthwhile if a step is provided above the cylindrical bearing surface for creating an axial stop in order to prevent the connecting element from slipping into the vertical pole.

In the case of an implemented sliding bearing, the kinetic friction occurring when the pin rotates in relation to the vertical pole can be influenced advantageously if the pin is mounted with the aid of a sliding sleeve in relation to the vertical pole. The lateral surface of the pin then slides against the inner surface of the sliding sleeve. The resulting practical advantage is that the friction can also be changed subsequently by replacing the sliding sleeve, which can be advantageous particularly in case of wear. The additional advantage of the use of a sliding sleeve is that it is no longer necessary to perform laborious surface processing of the corresponding inner surface of the vertical pole for producing a suitable bearing surface. In any case, an additional use of a lubricant for reducing friction can be worthwhile.

It is additionally feasible to influence the sliding friction in relation to the pin if the inner surface of the sliding sleeve comprises a profile that is oriented in the longitudinal direction of the sliding sleeve. Possible profiles are in the form of teeth, edges, corrugations or the like. The profile can reduce the sensitivity of the bearing to dirt and soiling. Furthermore, a selective contact pressure of the sliding sleeve on the pin or an appropriately selected structure of the lateral surface of the pin can change the properties of the bearing such as its resistance and clearance, in particular.

A subsequent change in the bearing properties can be implemented very advantageously if the sliding sleeve can be deformed by means acting on the sliding sleeve in the radial or circumferential direction. Such a deformation aims particularly at being able to subsequently reduce the cross-section of the sliding sleeve, at least partly, in order to influence, for example, the hold on the pin. This adaptability easily enables a precise adjustment of the bearing after its mounting and thus enables a reduction and optimization of the bearing clearance. Stresses caused by temperature, wear or loads can likewise be compensated. For this purpose, the sliding sleeve is preferably made of an elastic material (plastic or thin metals are advantageous).

In concrete terms, a deformation of the sliding sleeve can be achieved inter alia by providing the vertical pole with one or more passages in the bearing area for adjusting elements, preferably screws, acting on the sliding sleeve in the radial direction. The inner cross-section of the sliding sleeve can then be changed easily, from a technical viewpoint, by tightening or loosening the screws acting in the radial direction.

The quality of the bearing can further be enhanced by mounting the sliding sleeve in relation to the vertical pole by means of a holding sleeve. For this purpose, the holding sleeve has an approximately equal or slightly larger internal diameter than the external diameter of the sliding sleeve so that the holding sleeve can accommodate the sliding sleeve. For ensuring a secure mounting, the holding sleeve is provided with a cup-like design by virtue of the fact that it has an upper edge protruding outward over the vertical pole in the radial direction and a lower edge supporting the sliding sleeve and protruding inward in the radial direction. This arrangement prevents the sliding sleeve from sliding downward so that the bearing on the whole can also absorb axial forces.

In order to further ensure the cohesion of the bearing, it is advantageous to axially secure the sliding sleeve and/or the holding sleeve on that end of the pin that is oriented toward the vertical pole, which can be achieved easily, in terms of design, by means of a spring ring that engages in a peripheral groove of the pin.

Alternatively or additionally to the sliding bearing described above, it is feasible to mount that portion of the connecting element that is formed as a pin in relation to the vertical pole by means of one or more rolling bearings. A rolling bearing of such type, which can be formed as a ball bearing, roller bearing and/or needle bearing, ensures the easy rotation of the holding structure and at the same time high bearing precision and force absorption.

From a practical viewpoint, it will be desirable in most cases to lock the umbrella into position once the holding structure has been aligned. For this purpose, it is advantageous to provide locking means that can block the rotation of the holding structure in relation to the vertical pole. The rotation of the holding structure can be blocked using mechanisms acting with a form fit and/or force fit. Such locking means are intended to firstly block the rotating bearing as securely as possible during the period of use of the umbrella, and secondly enable the user to easily and safely unlock the rotating bearing for rapidly and conveniently realigning the umbrella.

A lock working with a predominantly form fit can be implemented by means of a locking element, which is connected non-rotatably to the holding structure or to the connecting element, in particular and which engages detachably in a profile formed on a peripheral section of the vertical pole.

For this purpose, such a locking element is formed at least on one engagement region approximately complementarily to the profile of the peripheral section, wherein different possible designs for the locking element, for example, in the form of a jaw, a sleeve, a shoe, a punch, pin, bolt or the like are feasible. For a snapping or latching engagement, the locking element could be disposed such that it can pivot and/or move on the vertical pole. The profile is preferably formed as circumferential teeth, it being feasible to also have other types of profiles such as edges, notches or the like.

Alternatively, the lock described in the previous paragraph can also be disposed the other way around, where the locking element is non-rotatably connected to the vertical pole and engages detachably in a profile formed on a peripheral section of the holding structure or the connecting element, in particular.

It is advantageous in both cases if a restoring force, preferably the restoring force of a spring, causes the locking element to engage with the profile. A technically simple design is feasible, for example, by means of a helical spring, leaf spring, spiral spring or the like. Lastly, a restoring force thus generated blocks a rotation of the holding structure in relation to the vertical pole when the locking element is not actuated. This secures the desired angular position of the holding structure, which can only be overridden by an intentional actuation of the locking element.

An opening, through which the engagement state of the locking element can be changed from the outside, preferably by means of an actuating button connected to the locking element, is advantageously disposed in the vertical pole. In this case, it is merely necessary to pull the actuating button, for example, for aligning the umbrella, whereupon the locking element unlocks the rotation of the connecting element.

Different possible designs are feasible with regard to the operating mode of the locking element. In particular, when designed as a jaw, shoe, punch or the like, the locking element can engage in the profile in the radial direction. The locking element can also be guided linearly or pivoted. This results in a particularly simple design from a technical viewpoint.

Alternatively, the locking element can engage in the profile in the axial direction. This results in the advantage of a small installation space for the locking mechanism since in this case the locking movement occurs in the direction of the vertical pole so that no actuating elements protrude outward from the vertical pole. For this purpose, the locking element is advantageously, in terms of design, formed as a moveable sleeve, which unlocks or blocks the rotation of the holding structure by moving in the axial direction. For this purpose, the sleeve preferably comprises internal teeth, which can extend over the entire length of the sleeve or only over individual, optionally separate parts thereof.

To enable a locking engagement, toothed rings are each connected to the holding structure, in particular the connecting element and the vertical pole, the toothed rings being disposed coaxially in relation to each other. The coaxial arrangement of the toothed rings enables an internally toothed sleeve to engage in both toothed rings at the same time. In a corresponding arrangement of the engaging regions and ability of the sleeve to move axially, such a locking or unlocking action is possible by "coupling or decoupling". The toothed rings could each be separate parts, which are attached to the respective components with a form fit and/or a force-fit, or they can be integrally formed with the respective component.

An easy operability and at the same time high security is ensured if the sleeve can be brought into two different positions by means of an axial movement, wherein in a first position the teeth of the sleeve engage in both the toothed rings and wherein in a second position the teeth of the sleeve engage in one of the toothed rings at most. By means of such a design a simple locking action in the sense of a coupling between the vertical pole and the holding structure is implemented, which coupling can be actuated easily—namely by an axial movement of the sleeve.

This design can be implemented, to additional advantage, by mounting one end section of the sleeve circumferentially and with axial clearance in a receiving sleeve. Due to the axial clearance enabled by the receiving sleeve for the sleeve contained therein, the latter can cover a length of stroke that is equal to the distance between the first and second positions, that is to say, the stretch of the locking process.

The holding structure of the umbrella can comprise a preferably arched post, on whose end that is disposed further away from the rotational axis, the umbrella canopy is suspended.

With regard to the mounting of the arched post, it is feasible to mount the same in relation to the connecting element or in relation to a rotating mast, which is connected to the connecting element and assigned to the holding structure. If the arched post is mounted in relation to the connecting element, the vertical pole could advantageously bridge approximately the entire installation height of the umbrella and would be provided with the appropriate length. This design enables economical production since an easy fabrication process can then be carried out at a stretch. In an alternative mounting of the arched post in relation to a rotating mast connected to the connecting element, the height of the vertical pole amounts to only a part of the required installation height. The remaining part of the required installation height is achieved by means of a rotating mast fitted on the connecting element, the advantage of which is that the rotating bearing can be disposed at a height that is easily accessible for the user. The rotating mast can have the visual and functional characteristics of the vertical pole so that despite the ability of the rotating mast to rotate in relation to the vertical pole, the two components at first glance give the overall impression of a one-piece pole.

In a development of the last-mentioned embodiments, the arched post is mounted in relation to the connecting element or the rotating mast by means of a tilting sleeve, which also preferably enables the arched post to move within the tilting sleeve. One particular advantage of this arrangement is that (for purposes of height adjustment) the arched post can be inclined to any extent in relation to the horizontal plane and/or slid through the tilting sleeve to any distance, at the user's discretion, which results in the umbrella canopy being spaced apart from the vertical pole. The possibly arched design of the post helps achieve a maximum horizontal spacing of the umbrella canopy from the vertical pole when the arched post is completely extended, if the umbrella canopy, viewed at in a vertical direction, is approximately at the height of the tilting sleeve.

That end of the arched post that is oriented away from the umbrella canopy is advantageously articulated with a supporting shaft. The supporting shaft holds the arched post in its position and stabilizes the same. Alternately to a supporting shaft, a rope absorbing merely tractive forces or the like could be used, depending on the design.

In an additionally advantageous manner, that end of the supporting shaft that is oriented away from the arched post is articulated with the vertical pole or optionally the rotating mast by means of a supporting holder. A stabilizing, indirect connection of the arched post with the vertical pole or the rotating mast is thus produced. The torque loads acting on the arched post due to the umbrella canopy mounted on the other end of the arched post are absorbed by the supporting shaft and transmitted into the vertical pole or the rotating mast.

For adjusting the desired position of the arched post, it can be advantageous if the supporting holder can move in relation to the vertical pole or optionally in relation to the rotating mast in the longitudinal direction thereof and/or rotate around the longitudinal axis thereof. While the ability of the supporting holder to move in relation to the vertical pole or the rotating mast can influence the inclination of the arched post, the ability of the supporting holder to rotate particularly in relation to the vertical pole (around the longitudinal axis thereof) can advantageously initiate the rotation of the entire holding structure.

The supporting holder can advantageously be attached to the vertical pole or optionally the rotating mast with a form fit and/or force fit. A connection, which is easy for the user to produce and detach, can be implemented by detachably clamping the supporting holder on the respective pole. The supporting holder could thus comprise a clamp body, which engages around the pole like a clip collar, wherein the clamp can be activated or overridden by flipping a bracket closing the clip collar. Such an attachment of the supporting holder to the vertical pole or the rotating mast results in the advantage of infinite adjustability, that is to say, the ability to move and/or rotate the supporting holder and subsequently attach it to the vertical pole or the rotating mast, and this infinite adjustability can be achieved easily in terms of design.

Figure 2B:
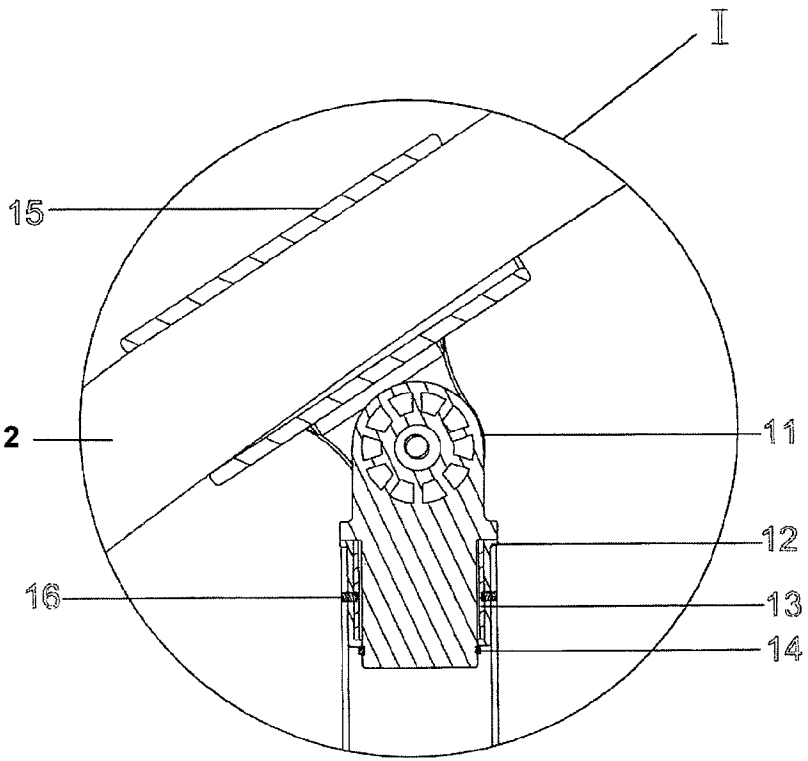
Figure 2A:
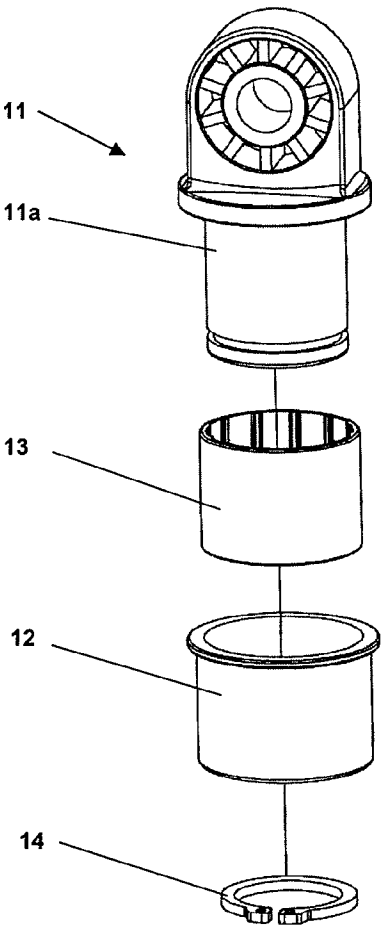
Figure 3:
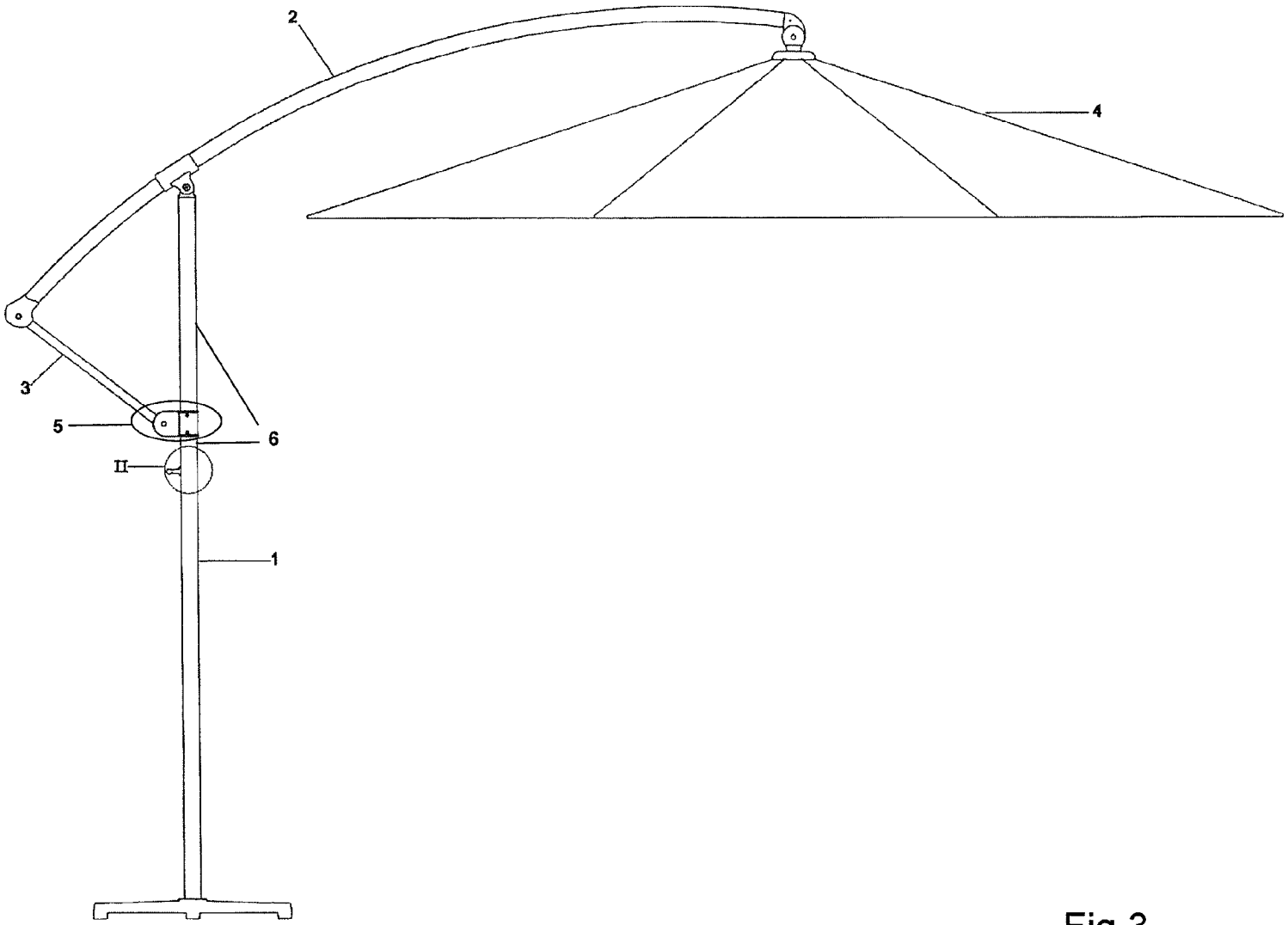
Figure 4:
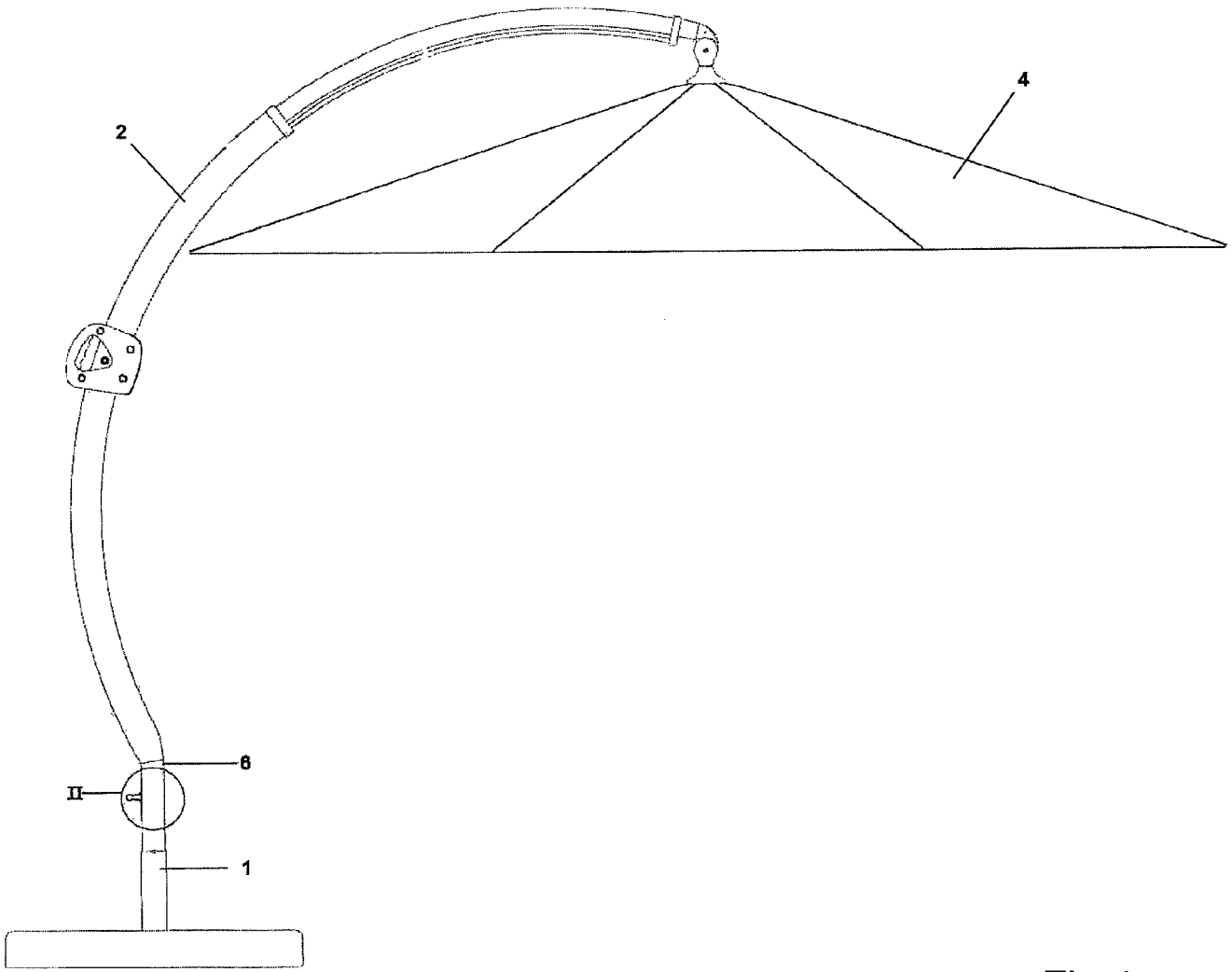
Figure 5B:
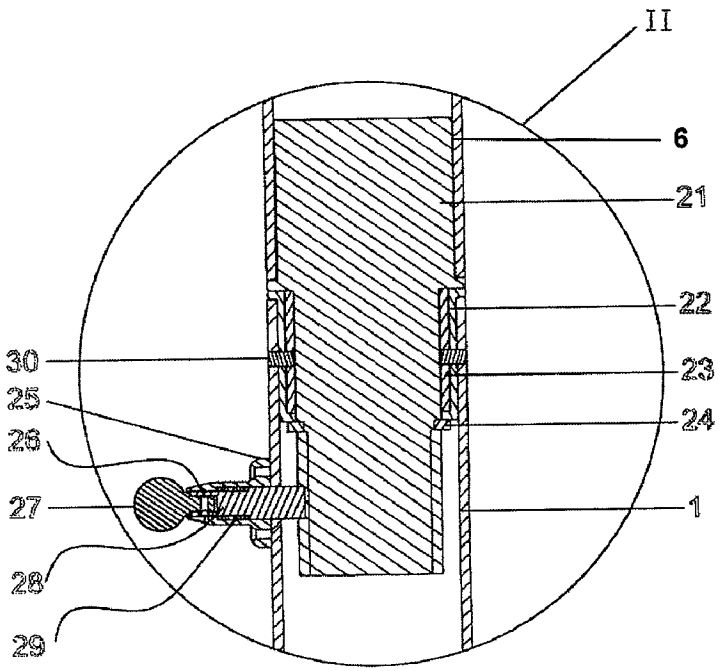
Figure 5A:
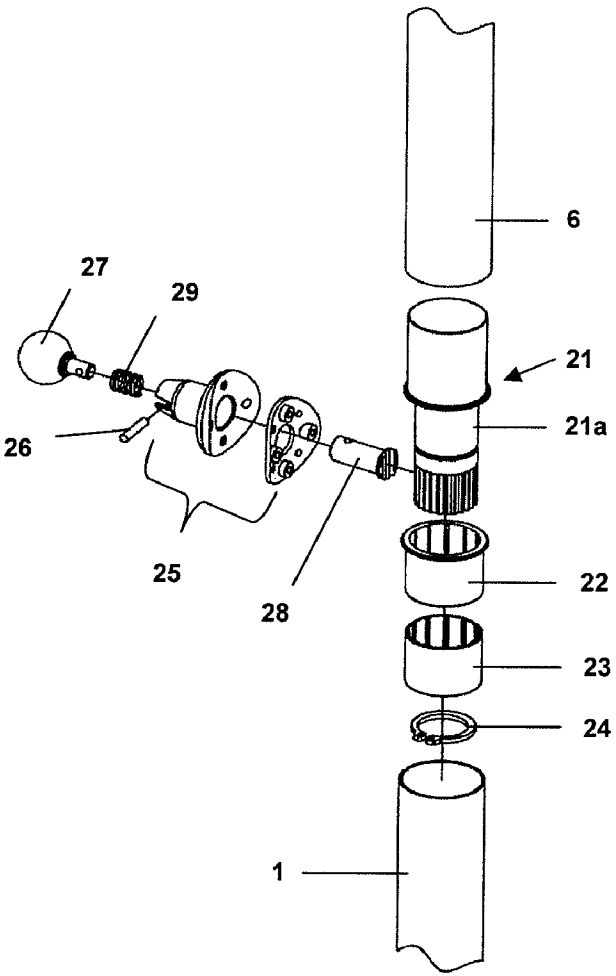
Figure 6:
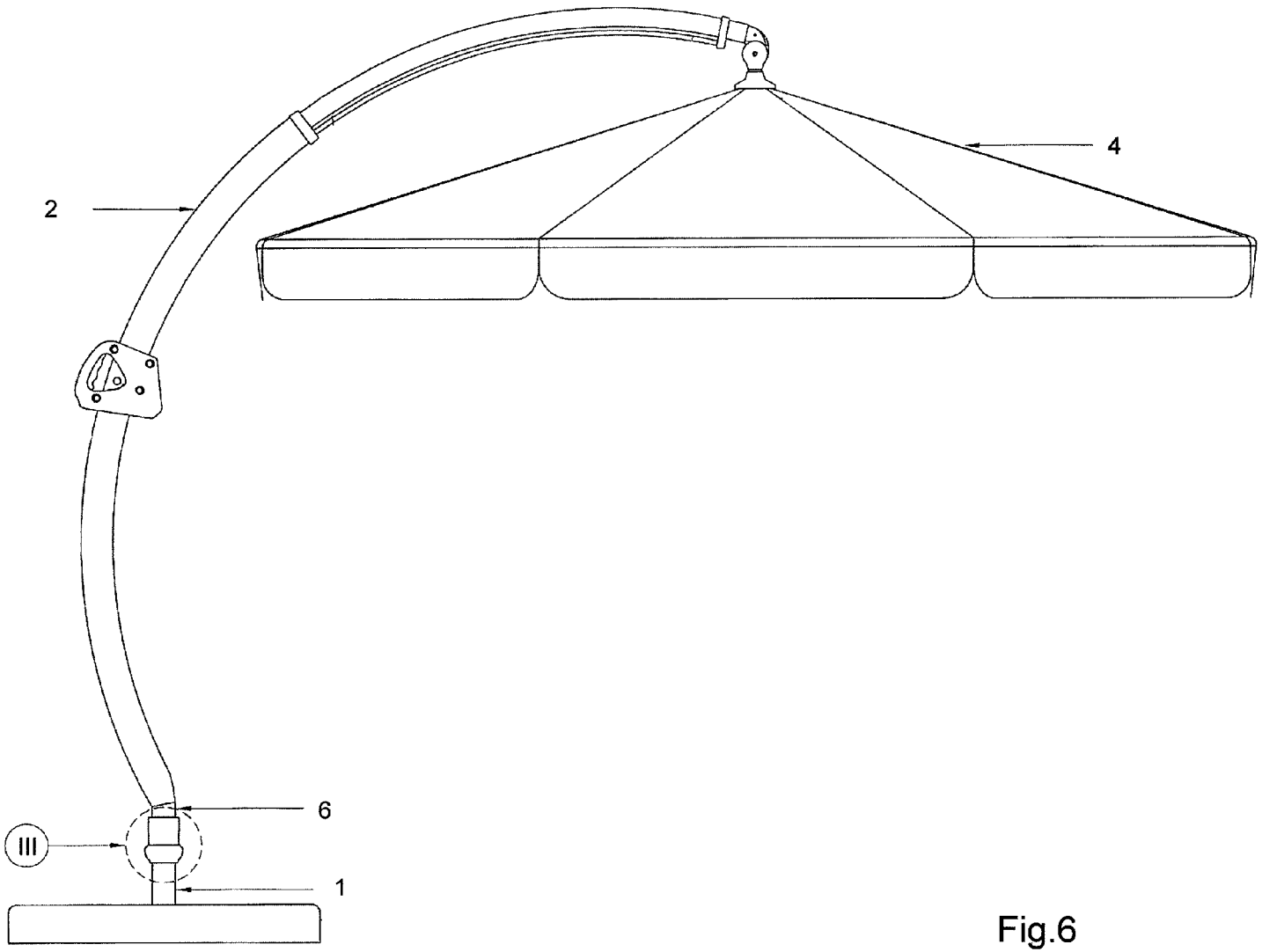
Figure 7B:
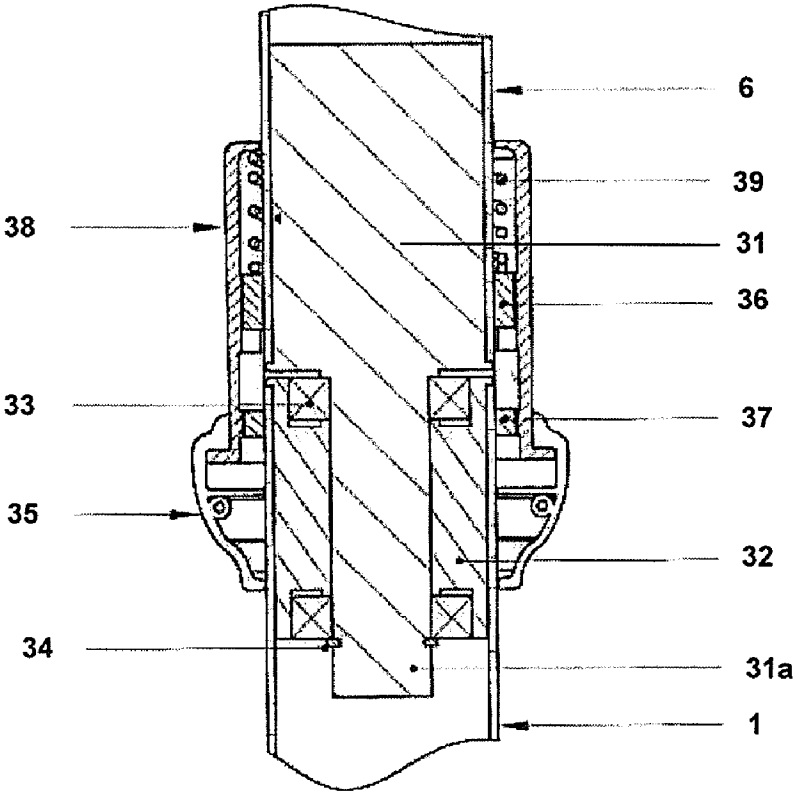
Figure 7A:
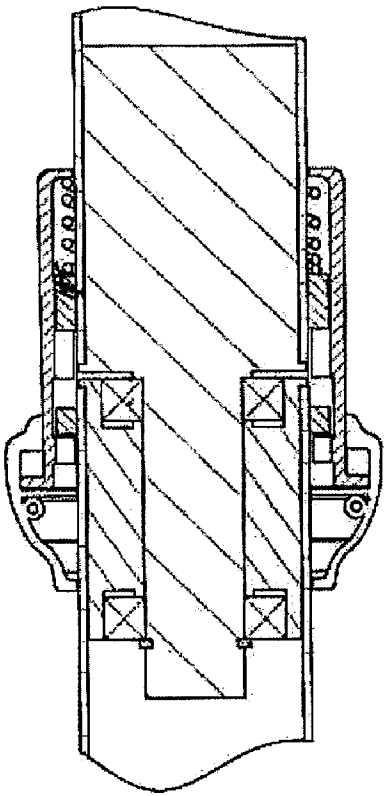
Figure 8:
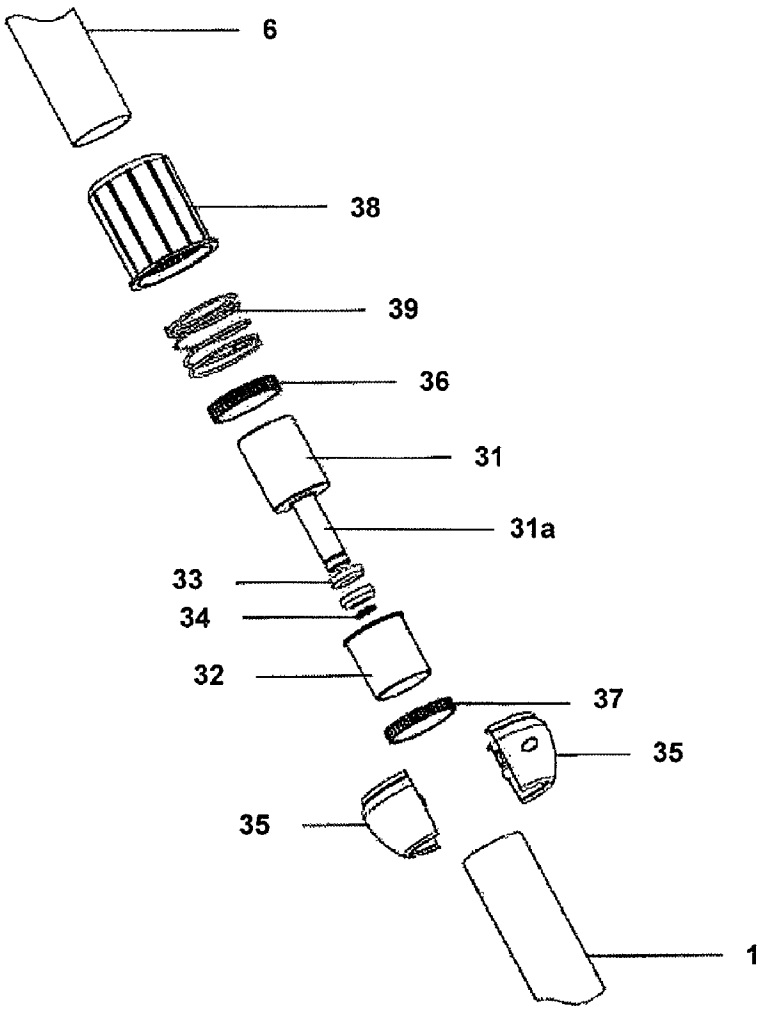

There are different possibilities of implementing and developing the teaching of the present invention to advantage. For this purpose, reference should be made firstly to the subordinate claims and secondly to the following explanation of preferred exemplary embodiments of the umbrella of the invention on the basis of the drawings. Generally preferred design forms and developments of the teaching of the invention have also been described together with the preferred exemplary embodiments with reference to the drawings, in which:

FIG. 1 is a side view of a first exemplary embodiment of an umbrella of the invention, FIG. 2*a* is an exploded view of detail I shown in FIG. 1, FIG. 2*b* is a cross-sectional side view of detail I shown in FIG. 1, FIG. 3 is a side view of a second exemplary embodiment of an umbrella of the invention, FIG. 4 is a side view of a third exemplary embodiment of an umbrella of the invention, FIG. 5*a* is an exploded view of detail II shown in FIGS. 3 and 4, FIG. 5*b* is a cross-sectional side view of detail II shown in FIGS. 3 and 4, FIG. 6 is a side view of a fourth exemplary embodiment of an umbrella of the invention, FIG. 7*a* is a cross-sectional side view of detail III shown in FIG. 6 in the unlocked state of the bearing, FIG. 7*b* is a cross-sectional side view of detail III shown in FIG. 6 in the locked state of the bearing and FIG. 8 is an exploded view of the bearing shown in FIGS. 7*a* and 7*b*.

FIG. 1 shows a first exemplary embodiment of an umbrella of the invention, which is formed as an offset umbrella. The umbrella comprises a vertical pole 1, which is anchored by means of a heavy pedestal in such a way that the vertical pole does not tilt over. A holding structure, which substantially comprises an arched post 2 and a supporting shaft 3 articulated therewith, is mounted such that the holding structure can rotate in relation to the vertical pole 1 and the rotational axis of the bearing coincides with the longitudinal axis of the vertical pole 1. The entire holding structure can therefore be rotated in the horizontal plane by 360° around the vertical pole 1. An umbrella canopy 4, which spaced apart from the vertical pole 1 in the radial direction, is suspended on the holding structure. The vertical pole 1, the arched post 2 and the supporting shaft 3 are all fabricated as continuous aluminum pipes having a round cross-section.

In order to enable an adjustment of the height of the umbrella canopy 4, the arched post 2 is mounted by means of a tilting sleeve 15 (shown only in FIG. 2*b*) such that the arched post 2 can be tilted in relation to the vertical pole 1. By virtue of the tilting movement of the tilting sleeve 15, the position of the umbrellas canopy 4 changes along the circular path defined by the end of the arched post 2. The umbrella canopy 4 can thus be lowered or raised, in particular. Furthermore, the arched post 2 can be moved within the tilting sleeve 15.

The forces occurring on the arched post 2 are transmitted into the vertical pole 1 by means of the tilting sleeve 15, the supporting shaft 3 and the supporting holder 5. The supporting holder 5 clasps around the vertical pole 1 using a clamp body like a clip collar. In its detached state, the supporting holder 5 can be moved in relation to the vertical pole 1 in the longitudinal direction thereof and rotated around the longitudinal axis thereof. Two screws that can be actuated using hand wheels are disposed on the clamp body of the supporting holder 5. The inner cross-section—and thus the clamping action—of the supporting holder 5 on the vertical pole 1 can be reduced or increased by tightening or loosening the screws respectively so as to easily enable a force-locked attachment or adjustment of the supporting holder 5 in relation to the vertical pole 1. The height of the umbrella canopy 4 can be adjusted by loosening and subsequently moving the supporting holder 5. Accordingly, the entire holding structure can rotate around the vertical pole 1 by a rotation of the supporting holder 5.

In an advantageous solution in terms of design, a sliding bearing is provided at the upper end of the vertical pole 1 (see detail I in FIGS. 1, 2*a* and 2*b*) for mounting the holding structure such that it can rotate in relation to the vertical pole 1. One particular advantage of this design worthy of mention is that as a result of the tiltably mounted sleeve 15, the bearing illustrated (detail I) is practically free of bending moments that would clearly hinder the ability of the bearing to rotate. For this reason, the sliding bearing shown in FIGS. 2*a* and 2*b* can also be used in relatively large layouts of umbrellas having a large spread.

As shown in FIG. 2*a*, the bearing substantially comprises a connecting element 11, one end of which is formed as a pin 11*a* having a substantially cylindrical basic shape. The lateral surface of the pin 11*a* acts as the slide-bearing surface in relation to the sliding sleeve 13 that is fixed in relation to the vertical pole 1. The sliding sleeve 13, the inner surface of which comprises a profile that is oriented in the longitudinal direction of the sliding sleeve, is received by the cup-shaped holding sleeve 12, and the holding sleeve 12 in turn is inserted into the upper open end of the vertical pole 1. For securing the connecting element 11, sliding sleeve 13 and the holding sleeve 12 in the axial direction, a spring ring 14 engages in a peripheral groove formed on the pin 11*a*.

For finely adjusting and optionally generating a defined braking effect, screws 16 are screwed through bores provided on the vertical pole 1 in order to act on the sliding sleeve 13 in the radial direction and in turn influence the cross-section thereof. A terminal lug, the passage of which is located coaxially in relation to the tilting axis of the tilting sleeve 15, is formed at the upper end of the connecting element 11.

FIG. 3 shows a second exemplary embodiment of an umbrella of the invention. Unlike the umbrella of the first exemplary embodiment, the rotating bearing of the holding structure in relation to the vertical pole 1 is not provided in the region of the tilting sleeve, which is likewise present, instead below the attachment point of the supporting shaft 3 to the vertical pole 1. The rotating bearing, marked by the circle II in FIG. 3, is shown in detail in FIGS. 5*a* and 5*b*. It can be inferred therefrom that the essential aspects of the bearing are similar to the sliding bearing shown in FIGS. 2*a* and 2*b*. A connecting element 21 is formed as a pin 21*a* with a substantially cylindrical basic shape on that end of the connecting element 21 that is oriented toward the vertical pole 1. A sliding sleeve 22 and a holding sleeve 23 are fitted on this connection pin 21*a* and secured in the axial direction by the spring ring 24, which engages in a peripheral groove formed on the pin 21*a*. Furthermore, passages are formed in the vertical pole 1 for screws 30, which act on the sliding sleeve 22 in the bearing area in the radial direction and thus permit a fine adjustment of the bearing.

At variance with the bearing shown in the first exemplary embodiment, the upper region of the connecting element 21 is also formed as a cylindrical pin, on which the hollow lower end of a rotating mast 6 is fitted.

Furthermore, at variance with the first exemplary embodiment, the rotation of the holding structure in relation to the vertical pole 1 can be blocked, for which purpose a locking mechanism is provided, which is likewise shown in FIGS. 5*a* and 5*b*. For this purpose, that peripheral section of the pin 21*a* that is located below the sliding bearing surface comprises teeth, which run in the longitudinal direction of the pin 21*a* and in which a locking bolt 28 engages detachably. The front surface of the locking bolt 28 is formed complementarily to the teeth of the pin 21*a*, and the locking bolt 28 is mounted in such a way by means of the bolt guide 25 that the locking bolt 28 can be moved in relation to the vertical pole 1. In its state of being pushed forward, that is to say, when the locking bolt 28 is engaged in the teeth of the pin 21*a*, the rotation of the connecting element 21 and thus the entire holding structure together with the umbrella canopy 4 is blocked. The engagement state is overridden by pushing the locking bolt 28 away from the pin 21*a* so that the rotation of the connecting element 21 is unlocked again.

A helical spring 29 disposed on the peripheral surface of the locking bolt 28 is supported against a step formed inside the bolt guide 25 so that the locking bolt 28 is forced by the spring force to engage with the teeth of the pin 21*a*.

An actuating button 27 is connected to the locking bolt 28 by means of the pin 26. By grasping and pulling away the actuating button 27, the user can temporarily override the lock in order to align the holding structure together with the umbrella canopy 4 in the desired position.

The bearing shown in FIGS. 5*a* and 5*b* is likewise used in a third exemplary embodiment of an umbrella of the invention, which is shown in FIG. 4. Here, the vertical pole 1 extends only to a small height at which the sliding bearing marked by the circle II and shown in FIGS. 5*a* and 5*b* is disposed. A short section of a rotating mast 6, which short section is permanently connected to an arched post 2, is joined above the rotating bearing. The arched post 2 is formed with a telescopic design so that its arched extension can be changed by retracting and extending the telescope shaft. A handle, which is used firstly for actuating the telescope shaft and secondly for rotating the holding structure, is formed at approximately half the height of the arched post 2.

FIG. 6 shows a fourth exemplary embodiment of an umbrella of the invention. The umbrella is similar to that shown in FIG. 4 in terms of its overall structure, which will therefore not be described again. In comparison to the umbrella shown in FIG. 4, the one shown in FIG. 6 comprises a differently designed bearing of the holding structure, which will be explained below.

FIGS. 7*a* and 7*b* show two different states of the bearing marked as detail III in FIG. 6. The individual elements of the bearing are only marked in FIG. 7*b* for the sake of simplicity. It can be seen in FIG. 7*b* that a connecting sleeve 32 is attached to the vertical pole 1. The upper end of the vertical pole 1 is provided with a hollow design and comprises an opening in order to receive the pin 31*a* of the connecting element 31. The pin 31*a* is formed with a cylindrical lateral surface, which is mounted by means of two rolling bearings such that it can rotate in relation to the vertical pole 1 or the connecting sleeve 32 attached thereto. A spring ring 34 prevents the connecting element 31 from slipping out upward in the axial direction. A toothed ring 36 is connected to the connecting element 31 and is permanently engaged with the internal teeth of the sleeve 38. An additional toothed ring 37 is non-rotatably connected to the connecting sleeve 32 and engages likewise in the internal teeth of the sleeve 38 in the state shown in FIG. 7*b*. Teeth of both the toothed rings 36 and 37 are oriented externally in a horizontal direction, as shown in FIGS. 7*a*, 7*b* and 8. The rotation of the connecting element 31 and thus the holding structure is therefore blocked. The spiral spring 39 disposed around the connecting element 31 between the toothed ring 36 and the upper end of the sleeve 38 ensures that the sleeve 38 is pressed upward in order to maintain the locked state.

In contrast, in the state shown in FIG. 7*a*, the sleeve 38 has been pressed downward from the first (upper) position (locked) shown in FIG. 7*b* into its second (lower) position (unlocked). The internal teeth formed only in certain regions of the sleeve 38 are therefore no longer engaged with the toothed ring 37 so that a free rotation of the connecting element 31 and thus the holding structure is possible.

The sleeve 38 is mounted in a receiving sleeve 35, as shown in the exploded view in FIG. 8. For this purpose, an end section of the sleeve 38 (in the mounted state) protrudes into the receiving sleeve 35 and can be moved in the axial direction along a given length of stroke. The receiving sleeve 35 is divided axially into two halves for facilitating the mounting process.

The formation of the bearing described above together with the locking mechanism has a particularly space-saving design since no parts requiring actuation protrude outward. Furthermore, the embodiment of the bearing described above poses a reduced risk of injury while simultaneously having enhanced visual appeal. The appropriate formation of the outer surface of the sleeve 38 for purposes of an ergonomically designed gripping surface results in comfortable, easy and safe operation.

Lastly, it should be pointed out that the exemplary embodiments described above serve to discuss the teaching claimed by way of example without restricting it to said embodiments.

The invention claimed is:

1. A suspended or offset umbrella, for use as protection from sun or rain, said umbrella comprising:

a vertical pole, an umbrella canopy, and a holding structure which is connected to the vertical pole and is intended for the umbrella canopy, wherein the holding structure is mounted such that it can rotate in relation to the vertical pole, and a rotational axis of a bearing that extends at least approximately parallel to the longitudinal axis of the vertical pole, wherein the umbrella canopy includes a top side and a bottom side that can be opened, and wherein the holding structure is connected to the top side and wherein the umbrella canopy is suspended from the top side by the holding structure to form the suspended umbrella, wherein the holding structure comprises a first member that is connected to a top of the canopy to suspend the canopy;

wherein the first member is connected to the vertical pole that comprises a second member that is vertically disposed;

the bearing disposed at an upper end of the vertical pole, said bearing configured to mount the holding structure such that the holding structure rotates in relation to the vertical pole, wherein a connecting sleeve is attached to the vertical pole;

said upper end of the vertical pole being hollow and comprising an opening in order to receive a pin of a connecting element of the holding structure, wherein the pin is formed with a cylindrical lateral surface, said pin mounted on the bearing and rotatable in relation to the vertical pole or the connecting sleeve; and a locking means configured to block the rotation of the holding structure in relation to the vertical pole, said locking means comprising:

an upper toothed ring having a plurality of externally oriented teeth, wherein the upper toothed ring is connected to the connecting element, wherein the upper toothed ring is permanently engaged with internal teeth of a sliding sleeve;

a lower toothed ring having a plurality of externally oriented teeth, wherein the lower toothed ring is disposed below the upper toothed ring and non-rotatably connected to the connecting sleeve, wherein the lower toothed ring is configured to engage the internal teeth of the sliding sleeve; and a spiral spring disposed around the connecting element between the upper toothed ring and upper end of the sliding sleeve, wherein the sliding sleeve is configured to engage the upper toothed ring and the lower toothed ring in a first position and a second position by means of axial movement of the sliding sleeve, wherein in a first position, the spiral spring is configured to apply an upward pressure on the sliding sleeve to maintain the locked state of the holding structure and the vertical pole by configuring the internal teeth of the sliding sleeve to engage with both the toothed rings, and wherein in the second position, the internal teeth of the sliding sleeve disengages from the lower toothed ring to configure the holding structure and the vertical pole to reach an unlocked state.

2. The umbrella according to claim 1, wherein the rotational axis coincides with the longitudinal axis of the vertical pole.

3. The umbrella according to claim 1, wherein the bearing is implemented by means of a rolling bearing or a sliding bearing.

4. The umbrella according to claim 1, wherein the pin is mounted by means of one or more rolling bearings in relation to the vertical pole.

5. The umbrella according to claim 1, wherein the locking means blocks the rotation of the holding structure in relation to the vertical pole by means of a form fit and/or force fit.

6. The umbrella according to claim 1, wherein the toothed rings are disposed coaxially in relation to each other, and wherein one end section of the sliding sleeve is mounted circumferentially and with axial clearance in a receiving sleeve, wherein the length of stroke of the sliding sleeve enabled by the axial clearance is equal to the distance between the first and second positions.

* * * * *